US007001857B2

(12) United States Patent
Degroote

(10) Patent No.: US 7,001,857 B2
(45) Date of Patent: Feb. 21, 2006

(54) BASALT CONTAINING FABRIC

(75) Inventor: Karel Degroote, Zwevegem (BE)

(73) Assignee: Groep Masureel Veredeling, Wevelgem (BE)

( * ) Notice: Subject to any disclaimer, the term of this patent is extended or adjusted under 35 U.S.C. 154(b) by 107 days.

(21) Appl. No.: 10/475,238

(22) PCT Filed: Apr. 19, 2001

(86) PCT No.: PCT/BE01/00068

§ 371 (c)(1),
(2), (4) Date: Oct. 17, 2003

(87) PCT Pub. No.: WO02/086213

PCT Pub. Date: Oct. 31, 2002

(65) Prior Publication Data

US 2004/0115439 A1 Jun. 17, 2004

(51) Int. Cl.
*B32B 27/12* (2006.01)

(52) U.S. Cl. ..... 442/136; 442/172; 442/176; 442/179; 442/180; 428/920; 428/921

(58) Field of Classification Search ..... 442/136, 442/172, 176, 179, 180; 428/920, 921
See application file for complete search history.

(56) References Cited

U.S. PATENT DOCUMENTS 4,778,844 A 10/1988 Blount
5,433,991 A 7/1995 Boyd, Jr. et al.
5,683,799 A * 11/1997 Olinger ..... 428/313.9

FOREIGN PATENT DOCUMENTS

DE 19816528 10/1999
FR 2217158 9/1974

OTHER PUBLICATIONS

Russian Application No. 2046854, Published Abstract No. XP002187140 in Week 26 of 1996.
Russian Application No. 2040609, Published Abstract No. XP002187141 in Week 15 of 1996.
Russian Application No. 2120783, Published Abstract No. XP002187142 in Week 12 of 2000.

* cited by examiner

*Primary Examiner*—Ula Ruddock
(74) *Attorney, Agent, or Firm*—Hovey Williams LLP

(57) ABSTRACT

A product includes a fabric made at least of yarns containing at least basalt fibers, the yarns or fibers being possibly at least partly provided with a sizing agent, said fabric having a weight of between about 100 g/m$^2$ and 2000 g/m$^2$. The product also includes at least a polyester polyurethane coating layer coating at least partly a face of the fabric, the coating having a polyester polyurethane weight of between about 5 and 100 g/m$^2$, advantageously between 10 and 50 g/m$^2$, preferably between 20 and 40 g/m$^2$.

40 Claims, 2 Drawing Sheets

BASALT CONTAINING FABRIC

THE STATE OF THE ART

Basalt fibers are well known in the art. They were developed starting in the seventies—mainly in the ex-USRR, with noted activities in the USA and to a lesser degree in Italy, UK, France, Germany—initially as wool, later on the basis of continuous extruded filaments.

Basalt fibers are sized at the filament extrusion step in order to improve some of their properties, like smoothening of the filament surface (i.e. filling possible surface micro cracks and hiding surface defects) to reduce the probability of filament breakage and decreasing the fiber friction coefficient to facilitate further processing steps as weaving, knitting, braiding, etc.

U.S. Pat. No. 4,778,844 teaches for example polyurethane flame retardant products consisting of polyurethane foam, possibly combined with basalt fibers or wool.

The reinforcement of polymers, such as epoxy, with basalt fibers, i.e. composite material, has already been taught by Subramanian et al in Sampe Quarterly, July 1977, pages 1 to 11.

It is also known to manufacture fabrics (knitted, woven, braided, etc.) from basalt yarns (made of basalt continuous filaments or fibers). The problems of these fabrics are:

- instability of the weave or fabric and vulnerability to defects during transportation and handling. These instability and vulnerability are mainly due to the low friction coefficient of the sized basalt fibers;
- instability of the sewn fabric at the seam;
- breakage problem when submitted to a curvature, whereby the fabrics cannot be sewn or folded, due to the high stiffness of basalt;
- naked basalt fabric irritates the skin when handled, due to the small diameter of the basalt filament ends and their stiffness;
- Etc.

Due to said problems, basalt fabrics have not been widely used for making clothes, especially fire protection clothes. Indeed, if the fabric is not stable, is irritating and can be broken by folding, such a fabric can not provide a safe fire protection.

It has now been found that by providing a thin coating on at least a face of a basalt fabric (advantageously on both of its faces), it is possible to obtain a flexible and stable fabric solving the problems of the known and marketed basalt fabrics. When bending and pinching the fabric of the invention, no or at least substantially no filament breakage appears. Due to its stability, flexibility and resistance to breakage when folded and pinched, the coated fabric of the invention has various possible applications, for example in fire protection, especially in the manufacture of fire protecting product, such as for example clothes or parts thereof.

BRIEF DESCRIPTION OF THE INVENTION

The invention relates to a flexible product comprising at least:

- a fabric made at least of yarns containing at least basalt fibers, said yarns or fibers being possibly at least partly provided with a sizing agent, said fabric having a weight comprised between 100 g/m$^2$ and 2000 g/m$^2$;
- at least a polyester polyurethane coating layer coating at least partly a face of the fabric, said coating having a polyester polyurethane weight comprised between 5 and 100 g/m$^2$, advantageously between 10 and 75 g/m$^2$, preferably between 20 and 40 g/m$^2$ when the layer is free or substantially free of pigments (such as solid coloring pigments) or solid particles (such as powder), or preferably between 35 and 65 g/m$^2$ when the layer comprises more than 1% by weight (advantageously more than 5% by weight, preferably more than 10% by weight) pigments and/or solid particles.

The flexible product of the invention is such that the coated face can be folded and pinched (pressing the folded face between fingers along the folding line), whereby two portions of the coated faces contact each other. The folding is carried out with a radius of curvature of less than 2 mm, advantageously of less than 1 mm, substantially without visible breakage of basalt fibers or filaments on the coated face. When only a face of the fabric is coated, the folding of the fabric does not form visible broken basalt fibers or filament on the coated side of the fabric, while some broken fibers or filaments are visible along the folding line on the uncoated side. The ratio number of visible broken fibers or filaments on the coated side along the folding line/number of visible broken fibers on the uncoated face along the folding line is advantageously less than 0.1, preferably less than 0.05, most preferably less than 0.01, especially less than 0.001, or even more. The number of visible broken fibers or filaments even on the uncoated face along the folding line is in any case low due to the passage of some coating agent between adjacent filaments or fibers.

When the two opposite faces of the fabric are coated with a polyester polyurethane layer, substantially no broken basalt fibers are visible on both sides along the bending line (radius of curvature of less than 1 mm).

The basalt fiber comprises advantageously more than 43% by weight, preferably at least 46% by weight of $SiO_2$, more preferably more than 50%, specifically more than 55% by weight $SiO_2$. The basalt fibers are advantageously acid type basalt fibers. The basalt fibers have also advantageously a high $Al_2O_3$ content, for example a $Al_2O_3$ content higher than 18% by weight (for example a content comprised between 18% and 24%), and a low (CaO,MgO) content, for example a (CaO,MgO) content of less than 8% by weight (for example comprised between 5% and 8%).

Preferably, the polyester polyurethane layer covers at least substantially uniformly a portion of a face of the fabric. According to an embodiment, a first face of the fabric is substantially completely coated with a polyester polyurethane layer, said coating being substantially uniform. The other face of the fabric (i.e. the face opposite to said first face) is possibly uncoated, but is advantageously also coated with a polymer layer, preferably with a polyester polyurethane layer.

According to a specific embodiment, the portion of the face of the fabric coated with a polyester polyurethane coating layer has a coating weight distribution such that for each cm$^2$ of the portion of the coated fabric, the weight of coating layer varies between 60% and 250% of the average coating weight, advantageously between 70% and 150%, preferably between 80% and 130%. A uniform distribution of the coating is advantageous for ensuring substantially uniform properties of the coated fabric (stability, resistance to breakage, etc.).

The yarns can comprise some fibers not made from basalt, for example steel fibers, glass fibers, carbon fibers, etc. However, advantageously the yarns comprise at least 75% by weight, advantageously more than 85% by weight, preferably more than 95% by weight of basalt fibers. For example, the yarns comprise more than 99% basalt fibers, or is made substantially completely from basalt fibers or filaments.

According to a detail of an embodiment, the polyester polyurethane coating layer coating a face of the fabric has a maximum coating weight (wet stage) of 100 g/m$^2$, advantageously a maximum coating weight of 65 g/m$^2$, preferably a maximum coating weight of 50 g/m$^2$. Possibly the said maximum coating weight at the wet stage can be higher than 100 g/m$^2$, such as 200 g/m$^2$ or even more.

According to a detail of another embodiment, the polyester polyurethane coating layer coating a face of the fabric has a maximum coating weight of 100 g/m$^2$, advantageously a maximum coating weight of 65 g/m$^2$, preferably a maximum coating weight of 50 g/m$^2$. Possibly the said maximum coating weight can be higher than 100 g/m$^2$.

Preferably, the polyester polyurethane layer comprises at least 50% by weight of polyester polyurethane. Most preferably, the polyester polyurethane layer comprises more than 75% by weight polyester polyurethane, for example more than 90% or even more than 95%. According to an embodiment, the coating layer comprises substantially only polyester polyurethane.

According to a detail of a preferred embodiment, the basalt fibers or filaments have a diameter comprised between 5 $\mu$m and 25 $\mu$m, preferably between 5 $\mu$m and 15 $\mu$m, and in that the yarns have a weight comprised between 50 tex and 2000 tex (1 tex=1 g for a length of 1000 m), advantageously between 100 tex and 1500 tex, such as between 100 and 1000 tex, preferably from 250 to 750 tex, most preferably lower than 500 tex. The yarns have for example an average equivalent diameter [equivalent diameter=4×(surface of the cross section of a yarn)/(outer length of the cross section)] comprised between 50 and 1000 $\mu$m, advantageously between 100 and 500 $\mu$m, for example between 200 and 400 $\mu$m, such as about 250 $\mu$m, about 300 $\mu$m, about 350 $\mu$m.

Possibly, at least a portion of a coated face with a polyester polyurethane layer is provided with one or more further layers. Said further layer can be a further polyester polyurethane layer or a layer having various properties, such as a heat insulating layer, etc.

Preferably, the portion of the fabric coated with a polyester polyurethane layer has a porosity made of pores of less than 50 $\mu$m, advantageously of less than 25 $\mu$m, preferably of less than 10 $\mu$m. Said portion is most preferably substantially impermeable to liquids. Most of the times in clothing, some gas permeability is desired and/or even required.

According to a possible embodiment, at least a portion of a coating layer comprises at least one, for example one or more, pigments and/or coloring pigments and/or metallic pigments (such as aluminum powders, metallic microfibers, etc.) and/or luminescent compounds (such as fluorescent compound(s) and/or a phosphorescent compound(s)).

According to still another possible embodiment, at least a face of the coated fabric (which can be for example a plain fabric or a satin fabric) is associated with a heat insulating layer and/or with a heat insulating layer on its both sides.

The invention relates also to an element comprising at least a product of the invention. Preferably, a portion of the product is sewn with another portion of the product or with another product of anyone of the preceding claims or with another fabrics or layer or sheet.

The product of the invention has various uses, such as for making inner layers in wall, floor, ceiling panels, fire resistance panels, covering laminates, such as for floor, seats, cushions, fire resistant mattresses, protective clothing, such as gloves, pancho's for forest fire fighters, tapes, canisters, tubes, heat protection envelopes (such as for pipes, valves, cables, electrical cables). These possible uses are given hereabove as non limiting examples.

The product of the invention finds thus possible uses in various sectors, such as construction, transport (transport of persons, transport of goods), car industry, trains, furniture, protective clothes, plant, machinery and equipment, etc.

In order to improve specific uses of the product of the invention, additional finishing coatings are possible, such as coating for soft and continuous contact with the skin (for example prepared by flocking), silicone coatings (for heat, weather and small impacts protection), elastic layer, intumescent layer (for fire-heat insulation), etc.

The invention relates also to a process for the preparation of a product of the invention, in which a basalt containing fabric is coated at least partly with an aqueous dispersion of a polyester polyurethane, said aqueous dispersion containing at least 10% by weight polyester polyurethane, advantageously from 20 to 70% by weight, preferably from 30 to 50% by weight polyester polyurethane. In said process, advantageously no organic solvents are used, so as to avoid safety problems (fire risks), as well as environmental problems. Preferably, the aqueous dispersion is free or substantially free of emulgators. Therefore, mineral pigments or particles, such as mineral powder, can be added to the coating dispersion before its application on the basalt fabric. Said pigments or other solid additives have advantageously a particle size of less than 2 $\mu$m, preferably of less than 1 $\mu$m, most preferably less than 0.1 $\mu$m.

The invention relates also to the use of a product according to the invention, as fire protection layer.

More specifically, objects of the invention are fire protection clothes, fingers, boots, mittens, gloves, cowls, helmets, pancho's, overcoats, etc., comprising at least a product or an element of the invention.

Details and characteristics of the invention will appear from the following description, in which reference is made to the attached drawings.

DESCRIPTION OF EMBODIMENTS

Figure 1:
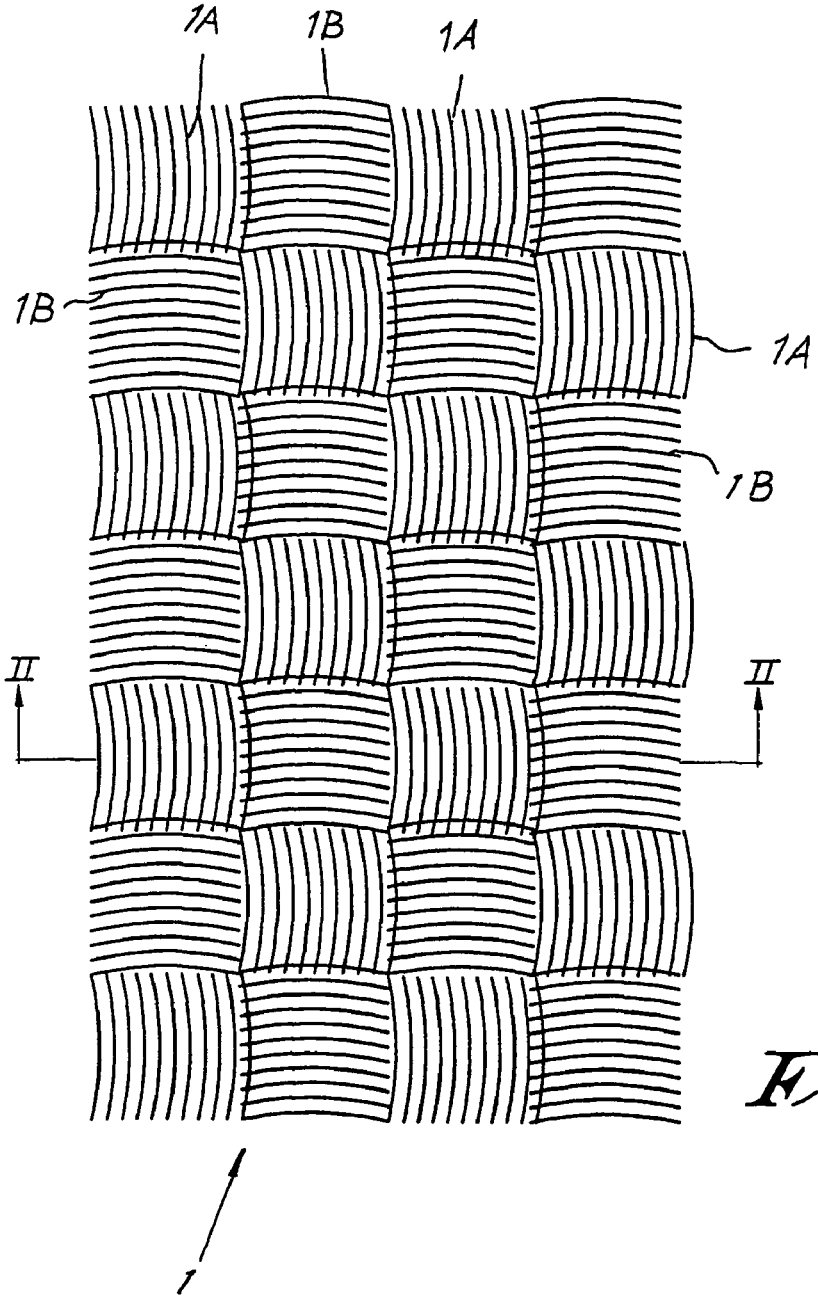
FIG. 1 is an upper (enlarged) view of a portion of a coated fabric of the invention.

FIG. 1 is a schematic view of a coated basalt fabric. The basalt fabric 1 has a weight of about 200 g/m$^2$ to 400 g/m$^2$ and is made of warp yarns 1A and weft yarns 1B, said weft yarns being crossed with respect to the warp yarns for example so as to pass once above and once under said warp yarns (plain binding). The density of yarns is 10 yarns/centimeter for the warp yarns and 8 yarns/centimeter for the weft yarns. The thickness E of the fabric before its coating is about 190 $\mu$m. The yarns are made from continuous basalt filament with a diameter comprised between 7 and 13 $\mu$m, for example about 9 $\mu$m, said yarns weigh about 117 tex and comprise about 100 to 1500 filaments, for example about 500 filaments. The basalt filaments are made from acid type basalt, with a $SiO_2$ content higher than 43%, advantageously higher than 46%, for example higher than 50% by weight. A slight torsion is carried out on the yarns so as improve the cohesion of the filaments the one with respect to the other, for example, the torsion is such that the yarn is submitted to a torsion from 5 to 50 times per meter, for example from 10 to 30 times per meter, preferably about 20 times.

A coating 2 is provided on the upper face of the fabric 1. Said coating is a polyester polyurethane coating, for example, a coating prepared from IMPRANIL DLN® sold by BAYER. The coating 2 is applied on the fabric as an aqueous dispersion at a polyester polyurethane rate of about 30 gm/m$^2$ (on a dry basis), meaning that the thickness of the coating 2 is less than 30 $\mu$m, as part of the coating dispersion flows in between filaments of yarns. The coated fabric has a total thickness of about 220 $\mu$m. The coating layer is regularly applied so that the thickness of the coating layer varies between 50% and 200%, advantageously from 80% to 130% of the average coating thickness. The thickness of the coating layer is higher in the valley portions of the fabric.

The face 3 of the fabric of FIG. 1 remains uncoated.

Figure 3:
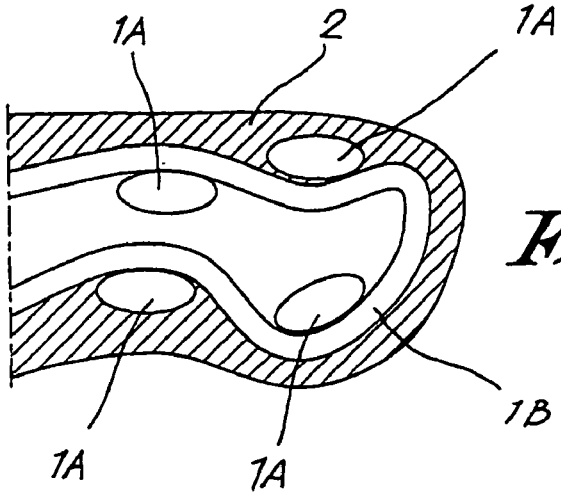
FIG. 3 is a cross section view of the coated fabric of FIG. 1 when folded.

When folding and pinched the coated fabric of FIG. 1 at the folding line (two portions of the face 3 are contacting each other—see FIG. 3), no breakage of basalt filament was visible on the coated face of the fabric, even if the radius of curvature was less than 500 $\mu$m.

The coated fabric has also the following properties:

- stable (relative movement between yarns is prevented, and even at least some relative movement between filaments are prevented);
- the coating is stable and is resistant to UV aging, as well as to temperature aging;
- excellent adhesion of the coating on the basalt fabric;
- the coating does not degrade the basalt fibers or filaments, nor their properties, during the application of the coating, as well as during its burning;
- the coating does not catch fire with propagating flame, nor produces toxic fumes, the coating disappears when burning in non toxic fumes;
- the coated face is non irritating (for example due to the absence of naked basalt filament ends);
- excellent resistance to flames after the disappearance of the coating without degradation of the basalt fabric due to the coating process;
- economical coating;
- excellent flexibility properties, whereby the coated fabric can be sewn;
- possibility of sewing with excellent stability at the seam;
- possibility to change, without any problem, the color of the fabric by simple addition of pigments to the polyester polyurethane dispersion (possibility to dissimulate without problem the natural color of basalt).

Figure 2:
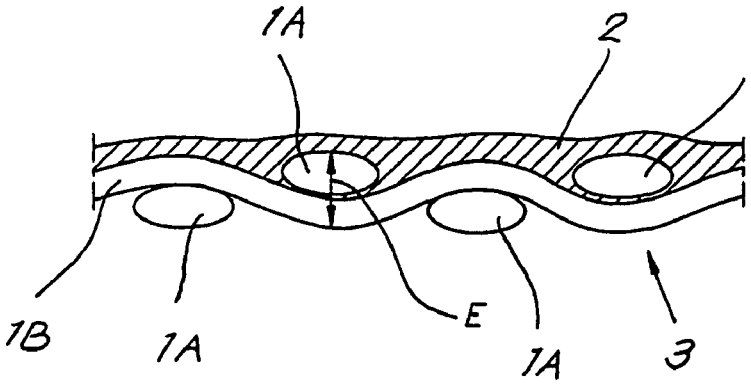
FIG. 2 is a cross section view of the coated fabric of FIG. 1 along the line II—II.
Figure 4:
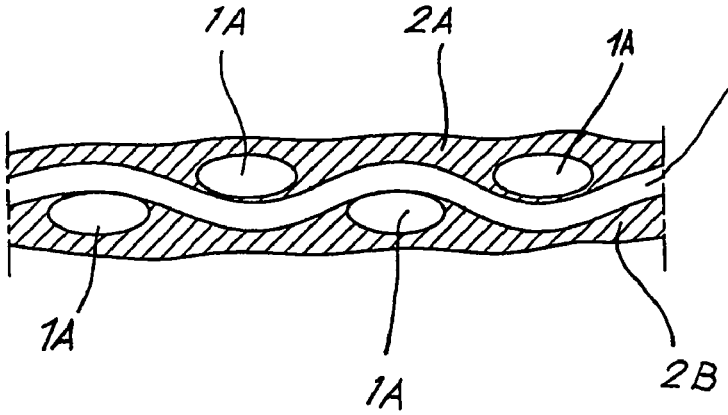
FIG. 4 is a cross section view of a coated fabric provided with a coating on both of its faces.

FIG. 4 is a view of a coated fabric similar to that shown in FIG. 2, except that both sides of the basalt fabric 1 are provided with a coating layer 2A,2B similar to that disclosed for the coated fabric of FIG. 1.

Instead of using a plain fabric as in example, a satin fabric can also be used for the preparation of a product according to the invention. For example, the satin fabric (with a satin binding=5/3) has a weight of 345 g/m$^2$, a thickness of 270 $\mu$m, number of weft yarns per cm: 13 and a number of warp yarns per cm: 22. The yarns have a weight corresponding to about 100 tex and are made from about 500 continuous basalt filaments having a diameter of about 10 $\mu$m. The filaments assembled for forming a yarn are submitted to a slight torsion for example about 20 torsions for a length of 1 m.

Said fabric was provided with a polyester polyurethane layer on one face as for the fabric of FIG. 1 and on both of its face as for the fabric of FIG. 4.

Figure 5:
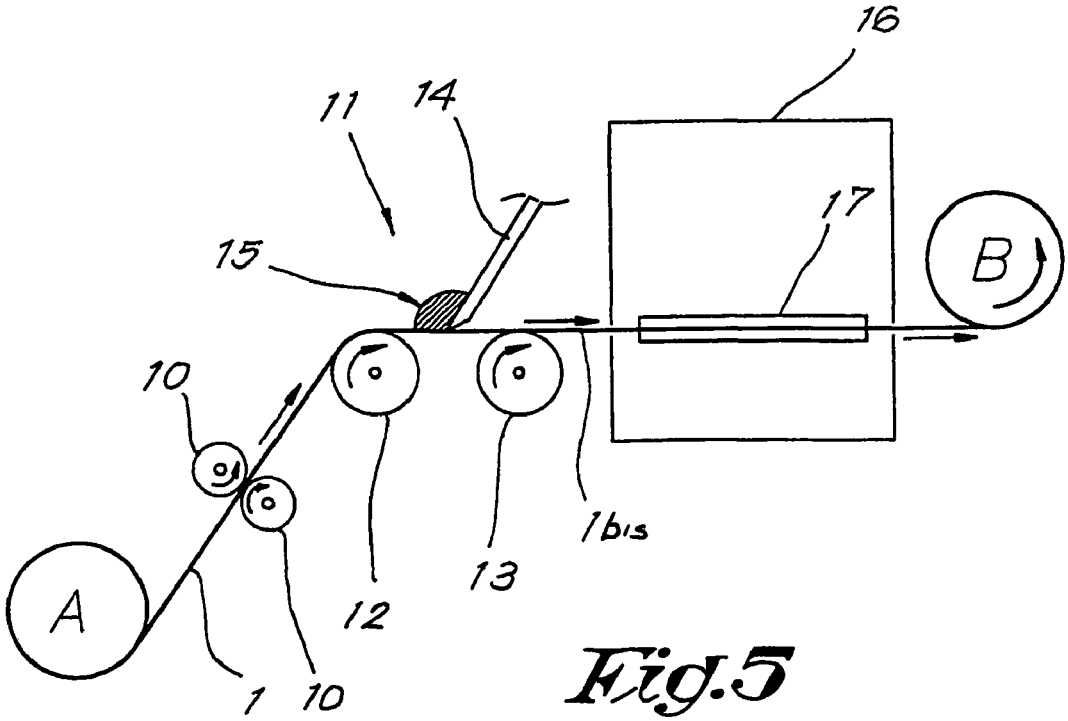
FIG. 5 is a schematic view of a process for manufacturing a coated fabric of the invention.

FIG. 5 is a schematic view of a process for manufacturing a coated fabric of FIG. 1.

The naked basalt fabric 1 is provided from a roll A and is pulled by a stenter in the dryer 16 and taken by the roll B on which the coated basalt fabric is enrolled. The naked basalt fabric passes through a pair of brake rollers 10 with a torque motor regulated so as to exert a low braking (for example torque motor regulated to less than 15%, advantageously less than 10% of the full braking capacity). The naked fabric 1 passes then in a knife over air system 11 comprising two support rollers 12,13 between which the fabric 1 extends substantially horizontally. A knife 14 contacts a portion of the fabric located between the two rollers 12,13, said knife 14 distributing an aqueous dispersion of polyester polyurethane 15. After the coating operation (which can be carried out at a temperature for example from 0° C. up to 100° C., advantageously from 10° C. up to 65° C., preferably from 15° C. up to 40° C.), the wet coated fabric 1 bis enters in a dryer 16. Said heater 16 comprises the stenter 17 exerting a force on the lateral edges of the fabric so as to limit the lateral or transversal stretching of the basalt fabric to less than 10%, advantageously to less than 2%, preferably so as to avoid or to prevent substantially any transversal stretching during the drying, most preferably so as to exert a kind of negative stretching during the drying. The fabric 1 is moved with a speed for example lower than 40 m/minute, such as a speed comprised between 10 and 25 m/minute.

The dryer 16 is advantageously using a direct gas heating or steam heating or oil heating, for example heated gas with a temperature comprised between 120° C. and 250° C., preferably with a temperature of about 150° C. when contacting the fabric to be dried (water evaporation and curing). The heated gas is for example combustion gas, but can also be heated air.

Possibly, before the coating operation, the fabric is prewetted with an aqueous medium or with water.

Possibly, also, the coating is made in a vacuum chamber.

Possibly, the coating operation and/or the drying operation are carried out in a controlled atmosphere, such as in an inert atmosphere (nitrogen).

When the two sides or faces of the fabric 1 have to be provided with a coating layer, the device disclosed in FIG. 5 is provided with a further coating system, preferably a coating system similar to the system 11. In this case, rollers are provided so as turn the lower face of the fabric upwards so as to enable the coating thereof with a system similar to the system 11.

Possibly the coating of the other face of the fabric can be operated after the drying of the first coating layer. Advantageously, the drying temperature of the first layer is lower than the curing temperature.

Various dispersions can be used in the process shown in FIG. 5. Said dispersion have advantageously a low viscosity for example a viscosity lower than 100 mPa.s at 23° C. and a pH comprised between 5 and 8, preferably from 6 to 7.5.

Example of possible dispersions are given hereafter, said dispersions being used at room temperature for the coating.

Dispersion 1: aqueous dispersion polyester polyurethane (Impranil DLN®) with a polyester polyurethane content of 40%

Dispersion 2: aqueous dispersion polyester polyurethane (Impranil DLN®) with a polyester polyurethane content of 45%

Dispersion 3: aqueous dispersion polyester polyurethane (Impranil DLN®) with a polyester polyurethane content of 20%

Dispersion 4: aqueous dispersion polyester polyurethane (Impranil DLN®) with a polyester polyurethane content of 20% and with pigment content of 10% (for example kaolin, etc.)

Dispersion 5: aqueous dispersion polyester polyurethane (Impranil DLN®) with a polyester polyurethane content of 20% and with pigment content of 20% (for example kaolin, etc.)

Dispersion 6: aqueous dispersion polyester polyurethane (Impranil DLN®) with a polyester polyurethane content of 20% and with a fluorescent pigment content of 5%

Dispersion 7: aqueous dispersion polyester polyurethane (Impranil DLN®) with a polyester polyurethane content of 5% and with a fluorescent pigment content of 5%

The various fabrics coated on one or both faces with one or more of the above dispersion can be sewn without any problem or breaking risks.

The product of the invention can have various uses, such as for making inner layers in wall, floor, ceiling panels, fire resistance panels, covering laminates, such as for car floor, seats, cushions, fire resistant mattresses, protective clothing, such as gloves, pancho's for forest fire fighters, tapes, canisters, tubes, heat protection envelope (such as for pipe, valves, cables, electrical cables.

Specific application fields are:

construction: wall, floor and ceiling paneling for building-in fire resistance, fire curtains such as automatically falling down to segment buildings, manufacturing halls, storage areas, tunnel, etc. in case of fire;

transportation: flexible rolls of floor covering laminates, fire resistance covering for seats, cushions, etc.

furniture: fire resistant mattresses, etc.

protective clothes, especially sewn protective clothes: overcoats, gloves, boots, etc. for example for fire fighter, forest fire fighter;

plant, machinery and equipment construction: fire protection of valves, pipes, cables, etc.

What is claimed is:

1. Product comprising:

a fabric made at least of yarns containing at least basalt fibers, said fabric having a weight comprised between 100 g/m$^2$ and 2000 g/m$^2$;

at least a polyester polyurethane coating layer coating at least partly a face of the fabric, said coating layer having a polyester polyurethane weight comprised between 5 and 100 g/m$^2$, when the coating is free or substantially free of solid particles, and a weight comprised between 35 and 65 g/m$^2$ when the coating layer comprises more than 1% by weight solid particles.

2. The product of claim 1, wherein the basalt fiber comprises at least 43% by weight of $SiO_2$.

3. The product of claim 1 wherein the polyester polyurethane layer coats at least substantially uniformly a portion of a face of the fabric.

4. The product of claim 1, wherein the portion of the face of the fabric coated with a polyester polyurethane coating layer has a coating weight distribution such that for each cm$^2$ of the portion of the coated fabric, the weight of coating layer varies between 60% and 250% of the average coating weight.

5. The product of claim 1, wherein the yarns comprise at least 75% by weight of basalt fibers.

6. The product of claim 1 wherein the two opposite faces of the fabric are coated with a polyester polyurethane coating layer.

7. The product of claim 1 wherein the polyester polyurethane coating layer coating a face of the fabric has a maximum coating weight of 100 g/m$^2$.

8. The product of claim 1 wherein the polyester polyurethane coating layer comprises at least 50% by weight of polyester polyurethane.

9. The product of claim 1 wherein the basalt fibers have a diameter comprised between 5 $\mu$m and 25 $\mu$m, and in which the yarns have a weight comprised between 50 and 2000 tex.

10. The product of claim 1 wherein at least a portion of a coated face with a polyester polyurethane layer is provided with at least one further layer.

11. The product of claim 1 wherein the portion of the fabric coated with a polyester polyurethane layer has a porosity made of pores of less than 50 $\mu$m.

12. The product of claim 1 wherein at least a portion of a coating layer comprises at least one compound selected from the group consisting of luminescent compounds, fluorescent compounds, phosphorescent compounds, pigments, metallic pigments, coloring pigments, and mixtures thereof.

13. The product of claim 1 wherein at least a fact of the coated fabric is associated with a heat insulating layer.

14. The product of claim 1, in which the polyester polyurethane coating layer coating at least partly a face of the fabric has a polyester polyurethane weight comprised between 10 g/m$^2$ and 75 g/m$^2$, when the coating is free or substantially free of solid particles.

15. The product of claim 1, in which the polyester polyurethane coating layer coating at least partly a face of the fabric has a polyester polyurethane weight comprised between 20 g/m$^2$ and 40 g/m$^2$, when the coating is free or substantially free of solid particles.

16. The product of claim 1, in which the basalt fiber comprises at least 46% by weight of $SiO_2$.

17. The product of claim 1, in which the basalt fiber comprises at least 50% by weight of $SiO_2$.

18. The product of claim 1, in which the portion of the face of the fabric coated with a polyester polyurethane coating layer has a coating weight distribution such that for each cm$^2$ of the portion of the coated fabric, the weight of coating layer varies between 70% and 150% of the average coating weight.

19. The product of claim 1, in which the portion of the face of the fabric coated with a polyester polyurethane coating layer has a coating weight distribution such that for each cm$^2$ of the portion of the coated fabric, the weight of coating layer varies between 80% and 130% of the average coating weight.

20. The product of claim 1, in which the yarns comprise at least 85% by weight of basalt fibers.

21. The product of claim 1, in which the yarns comprise at least 95% by weight of basalt fibers.

22. The product of claim 1, in which the polyester polyurethane coating layer coating a face of the fabric has a maximum coating weight of less than 65 g/m$^2$.

23. The product of claim 1, in which the basalt fibers have a diameter comprised between 5 $\mu$m and 15 $\mu$m, and in which the yarns have a weight comprised between 100 tex and 1000 tex.

24. The product of claim 1, in which the portion of the fabric coated with a polyester polyurethane layer has a porosity made of pores of less than 25 $\mu$m.

25. The product of claim 1, in which the portion of the fabric coated with a polyester polyurethane layer has a porosity made of pores of less than 10 $\mu$m.

26. An element comprising at least a product comprising:

a fabric made at least of yarns containing at least basalt fibers, said fabric having a weight comprised between 100 g/m$^2$ and 2000 g/m$^2$;

at least a polyester polyurethane coating layer coating at least partly a face of the fabric, said coating layer having a polyester polyurethane weight selected from the group consisting of a weight comprised between 5 g/m$^2$ and 100 g/m$^2$, when the coating is free or substantially free of solid particles, and a weight comprised between 35 g/m$^2$ and 65 g/m$^2$ when the coating layer comprises more than 1% by weight solid particles, in which at least a portion of the product is sewn with another portion selected from the group consisting of a portion of the product and a portion of another product of any one of the preceding claims or with another fabrics or layer or sheet.

27. The element of claim 26, in which the basalt fiber of the product comprises at least 43% by weight of $SiO_2$.

28. The element of claim 26, in which the polyester polyurethane layer coats at least substantially uniformly a portion of a face of the fabric of the product.

29. The element of claim 26, in which the portion of the face of the fabric coated with a polyester polyurethane coating layer has a coating weight distribution such that for each cm$^2$ of the portion of the coated fabric, the weight of coating layer varies between 60% and 250% of the average coating weight.

30. The element of claim 26, in which the yarns of the fabric of the product comprise at least 75% by weight of basalt fibers.

31. The element of claim 26, in which the two opposite faces of the fabric of the product are coated with a polyester polyurethane coating layer.

32. The element of claim 26, in which the polyester polyurethane coating layer coating a face of the fabric of the product has a maximum coating weight of 100 g/m$^2$.

33. The element of claim 26, in which the polyester polyurethane coating layer of the product comprises at least 50% by weight of polyester polyurethane.

34. The element of claim 26, in which the basalt fibers of the fabric of the product has a diameter comprised between 5 $\mu$m and 25 $\mu$m, and in which the yarns of the fabric have a weight comprised between 50 tex and 2000 tex.

35. The element of claim 26, in which at least a portion of a coated face with a polyester polyurethane layer of the product is provided with at least one further layer.

36. A process for the preparation of a product comprising:

a fabric made at least of yarns containing at least basalt fibers, said fabric having a weight comprised between 100 g/m$^2$ and 2000 g/m$^2$;

at least a polyester polyurethane coating layer coating at least partly a face of the fabric, said coating layer having a polyester polyurethane weight selected from the group consisting of a weight comprises between 5 and 100 g/m$^2$, when the coating is free or substantially free of solid particles, and a weight comprised between 35 and 65 g/m$^2$ when the coating layer comprises more than 1% by weight solid particles, in which the basalt fiber containing fabric is coated at least partly with an aqueous dispersion of a polyester polyurethane, said aqueous dispersion containing at least 10% by weight polyester polyurethane.

37. The process of claim 36, in which the basalt containing fabric is coated at least partly with an aqueous dispersion of a polyester polyurethane, said aqueous dispersion containing from 20% to 70% by weight polyester polyurethane.

38. The process of claim 36, in which the basalt containing fabric is coated at least partly with an aqueous dispersion of a polyester polyurethane, said aqueous dispersion containing from 30% to 50% by weight polyester polyurethane.

39. The use of a product comprising:

a fabric made at least of yarns containing at least basalt fibers, said fabric having a weight comprised between 100 g/m$^2$ and 2000 g/m$^2$;

at least a polyester and polyurethane coating layer coating at least partly a face of the fabric, said coating layer having a polyester polyurethane weight selected from the group consisting of a weight comprised between 5 g/m$^2$ and 100 g/m$^2$, when the coating is free or substantially free of solid particles, and a weight comprised between 35 g/m$^2$ and 65 g/m$^2$ when the coating layer comprises more than 1% by weight solid particles, as fire protection layer.

40. Fire protection garment selected from the group consisting of clothes, finger, boots, mittens, gloves, cowls, helmets, said garment comprising at least a product comprising:

a fabric made at least of yarns containing at least basalt fibers, said fabric having a weights comprised between 100 g/m$^2$ and 2000 g/m$^2$;

at least a polyester polyurethane coating layer coating at least partly a face of the fabric, said coating layer having a polyester polyurethane weight selected from the group consisting of a weight comprised between 5 g/m$^2$ and 100 g/m$^2$, when the coating is free or substantially free of solid particles, and a weight comprised between 35 g/m$^2$ and 65 g/m$^2$ when the coating layer comprises more than 1% by weight solid particles.

* * * * *